US009245473B2

(12) United States Patent
Kim et al.

(10) Patent No.: US 9,245,473 B2
(45) Date of Patent: Jan. 26, 2016

(54) DISPLAY DEVICE AND DRIVING METHOD THEREOF

(71) Applicant: SAMSUNG DISPLAY CO., LTD., Yongin, Gyeonggi-Do (KR)

(72) Inventors: Young Kim, Gyeonggi-Do (KR); Jin Young Jeon, Chungcheongnam-do (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 23 days.

(21) Appl. No.: 14/313,222

(22) Filed: Jun. 24, 2014

(65) Prior Publication Data

US 2015/0042627 A1 Feb. 12, 2015

(30) Foreign Application Priority Data

Aug. 6, 2013 (KR) ..... 10-2013-0093235

(51) Int. Cl.

*G09G 5/00* (2006.01)
*G09G 3/20* (2006.01)
*G09G 3/36* (2006.01)

(52) U.S. Cl.

CPC ..... *G09G 3/2003* (2013.01); *G09G 3/2096* (2013.01); *G09G 3/3685* (2013.01); *G09G 5/008* (2013.01)

(58) Field of Classification Search

CPC . G09G 3/2003; G09G 3/2096; G09G 3/3648; G09G 3/3685; G09G 3/3688; G09G 5/006; G09G 5/008; G09G 2310/027; G02F 1/133
See application file for complete search history.

(56) References Cited

U.S. PATENT DOCUMENTS 6,020,872 A * 2/2000 Mizukata ..... G09G 5/008 345/213
7,180,498 B2 * 2/2007 Hiraki ..... G09G 3/3688 345/208
7,202,865 B2 * 4/2007 Arai ..... H03L 7/18 345/204
7,522,131 B2 * 4/2009 Kang ..... G09G 3/22 345/74.1
8,139,012 B2 * 3/2012 Fukui ..... G09G 3/3614 345/58
8,159,439 B2 * 4/2012 Lee ..... G09G 3/3688 345/208
2002/0008661 A1 1/2002 McCall et al.
2002/0075255 A1 * 6/2002 Baek ..... G09G 5/006 345/212
2003/0016189 A1 * 1/2003 Abe ..... G09G 3/20 345/55
2006/0267901 A1 * 11/2006 Maekawa ..... G09G 3/3696 345/98
2006/0274011 A1 * 12/2006 Igarashi ..... G09G 3/3648 345/94
2008/0170062 A1 * 7/2008 Ma ..... G06F 1/04 345/214
2009/0040244 A1 * 2/2009 Lee ..... G09G 3/3696 345/690
2010/0066708 A1 * 3/2010 Kim ..... G09G 3/3614 345/204
2010/0128022 A1 * 5/2010 Takada ..... G09G 3/3696 345/213
2012/0320018 A1 * 12/2012 Saitoh ..... G09G 3/3655 345/209
2013/0293515 A1 * 11/2013 Fujioka ..... G06F 3/044 345/174
2014/0347334 A1 * 11/2014 Nii ..... G09G 3/3611 345/204

FOREIGN PATENT DOCUMENTS

KR 10-2004-0054614 A 6/2004
KR 10-2011-0064775 A 5/2011

* cited by examiner

*Primary Examiner* — Joe H Cheng
(74) *Attorney, Agent, or Firm* — Lee & Morse, P.C.

(57) ABSTRACT

A display device includes a clock oscillator, a register, and a data driver. The clock oscillator generates a clock signal. The register stores a clock signal parameter for the clock signal. The data driver determines a number of clock signals in 1 horizontal period based on the clock signal parameter, and applies data signals to data lines connected to a plurality of pixels based on the 1 horizontal period.

20 Claims, 6 Drawing Sheets

DISPLAY DEVICE AND DRIVING METHOD THEREOF

CROSS-REFERENCE TO RELATED APPLICATION

Korean Patent Application No. 10-2013-0093235, filed on Aug. 6, 2013, and entitled, "Display Device and Driving Method Thereof," is incorporated by reference herein in its entirety.

BACKGROUND

1. Field

One or more embodiments described herein relate to a display device.

2. Description of the Related Art

A display device generally includes scan lines and data lines connected to a plurality of pixels. In operation, scan signals are sequentially applied to the scan lines, and data signals are applied to the data lines in response to the scan signals. As a result, image data is written in the pixels. When the scan and data signals are properly synchronized, a correct image may be displayed.

Also, in terms of synchronization, the frequency of a frame in which an image is displayed may be set to coincide with the frequency of the data signal corresponding to the image in one frame. When these frequencies do not coincide, a tearing phenomenon may occur, in which two or more images are simultaneously displayed on a same screen.

For example, when the tearing phenomenon occurs, data of two or more frames may be divided and displayed on one screen. Also, R, G, and B colors of the pixels may be updated to data in a next frame. As a result, dot noise may occur in which different colors are displayed. All of these effects reduce display quality.

SUMMARY

In accordance with one embodiment, a display device includes a clock oscillator configured to generate a clock signal; a register configured to store a clock signal parameter for the clock signal; and a data driver configured to determine a number of clock signals in 1 horizontal period based on the clock signal parameter, and to apply a plurality of data signals to a plurality of data lines connected to a plurality of pixels based on the 1 horizontal period.

The data driver may apply the data signals to the data lines at an interval of the 1 horizontal period. The clock oscillator may generate the clock signal when a still image is to be displayed. The data driver may receive a main clock signal when moving images are to be displayed, and may receive the clock signal instead of the main clock signal when the still image is to be displayed.

The clock signal parameter may indicate the number of clock signals in the 1 horizontal period based on 1 horizontal width unit, and the 1 horizontal width may include two clock signals. The clock signal parameter may indicate the number of clock signals in the 1 horizontal period.

The clock signal parameter may indicate the number of clock signals in the 1 horizontal period, and the number of clock signals in the 1 horizontal period may allow a synchronized frame for outputting the data signals to substantially coincide with a reference frame. The clock signal parameter may be a predetermined number of bits, for example, 10 bits.

In accordance with another embodiment, a method for driving a display device includes receiving a clock signal to synchronize applying data signals to data lines to which a plurality of pixels is connected; receiving a clock signal parameter for the clock signal; determining a width of 1 horizontal period based on the clock signal parameter; and outputting the data signals to the data lines at an interval of the 1 horizontal period. The clock signal parameter may indicate the number of clock signals in the 1 horizontal period for 1 horizontal width unit, and the 1 horizontal width may include two clock signals.

The clock signal parameter may indicate the number of clock signals in the 1 horizontal period. The clock signal parameter may indicate the number of clock signals in the 1 horizontal period, and the number of clock signals in the 1 horizontal period may allow a synchronized frame outputting the data signals to substantially coincide with a reference frame. The clock signal may be generated when a still image is to be displayed.

The method may include pre-registering the clock signal parameter in a register. Pre-registering the clock signal parameter may include detecting a vertical synchronization signal of the display device; detecting a frame period of the display device based on the vertical synchronization signal; measuring a frequency of the clock signal; and calculating the number of clock signals in the 1 horizontal period included in the frame. The frame period may be substantially equal to the period of the vertical synchronization signal.

In accordance with another embodiment, an apparatus includes at least one input; and a driver to receive a signal including a clock signal parameter through the input, wherein the driver is to determine a number of clock signals in a period of a display device based on the clock signal parameter and is to control data signals to data lines of the display device based on the period. The clock signal parameter may be a predetermined number of bits.

The clock signal parameter may indicate the number of clock signals in the period based on 1 horizontal width unit, and the 1 horizontal width includes a plurality of clock signals. The plurality of clock signals may be two clock signals. The clock signal parameter may indicate the number of clock signals in the 1 horizontal period, and the number of clock signals in the 1 horizontal period may allow a synchronized frame for outputting the data signals to substantially coincide with a reference frame.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
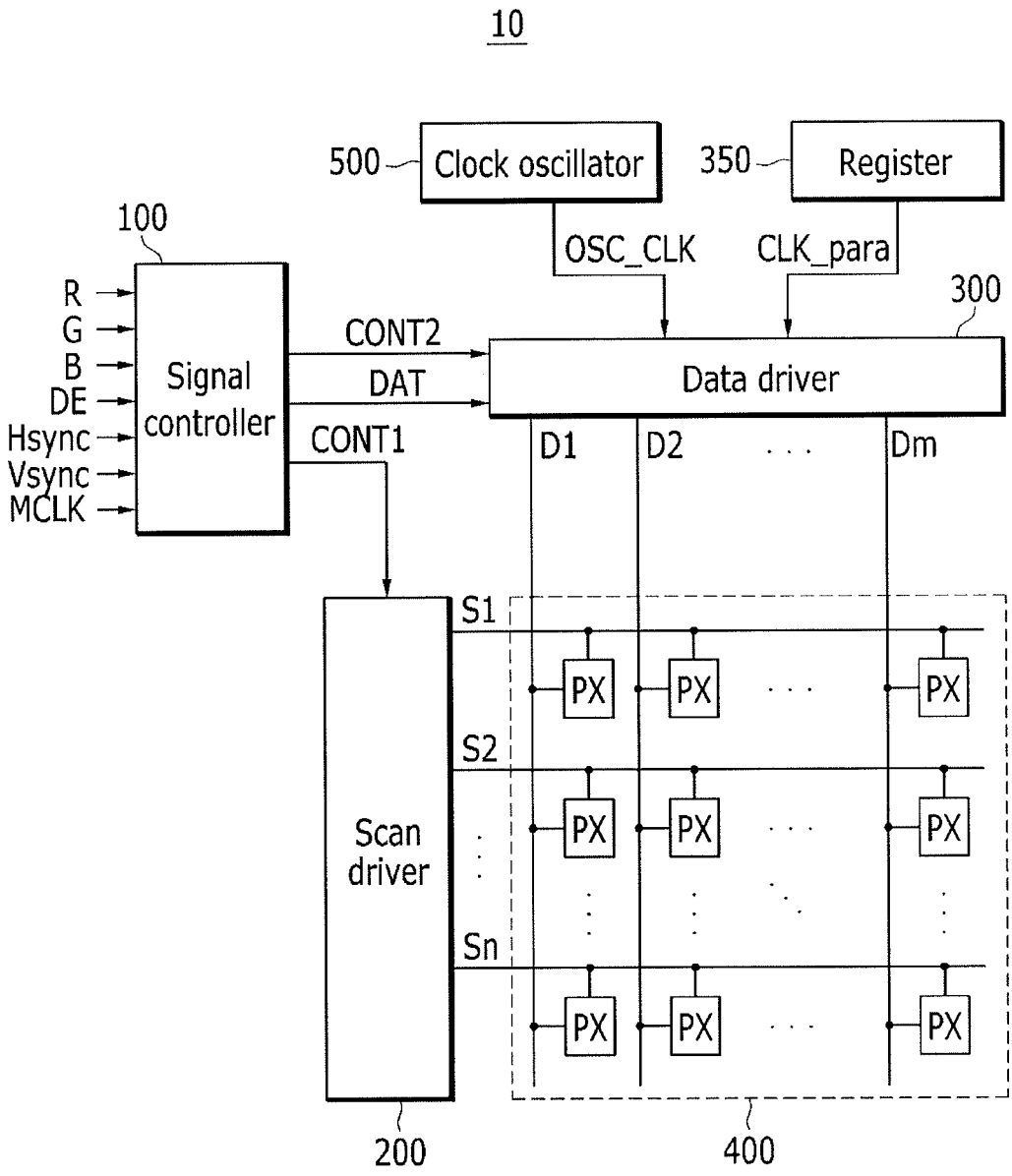
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawing figures, the dimensions of layers and regions may be exaggerated for clarity of illustration.

FIG. 1 illustrates an embodiment of a display device 10 which includes a signal controller 100, a scan driver 200, a data driver 300, a display unit 400, a register 350, and a clock oscillator 500. In FIG. 1, register 350 and clock oscillator 500 are illustrated to be outside data driver 300. In other embodiments, one or both of register 350 and clock oscillator 500 may be within data driver 300.

The display unit 400 includes a plurality of pixels PX arranged substantially in a matrix form, a plurality of scan lines S1 to Sn, and a plurality of data lines D1 to Dm. The pixels PX are connected to respective ones of the scan lines S1 to Sn and data lines D1 to Dm. The scan lines S1 to Sn extend substantially in a row direction and may be parallel to each other. The data lines D1 to Dm extend in a column direction and may be parallel to each other.

The signal controller 100 receives image signals R, G, and B and at least one synchronization signal from an external device. The image signals R, G, and B store luminance information for the pixels. Luminance may be expressed, for example, within a predetermined range of gray scale values, for example, 1024(=$2^{10}$), 256(=$2^8$) or 64(=$2^6$) gray scale values. The at least one synchronization signal may include a data enable signal DE, a horizontal synchronization signal Hsync, a vertical synchronization signal Vsync, and/or a main clock signal MCLK.

The signal controller 100 generates a first driving control signal CONT1, a second driving control signal CONT2, and an image data DAT according to the image signals R, G, and B, the data enable signal DE, the horizontal synchronization signal Hsync, the vertical synchronization signal Vsync, and the main clock signal MCLK.

The signal controller 100 divides the image signals R, G, and B by a frame unit according to the vertical synchronization signal Vsync. The signal controller 100 divides the image signals R, G, and B by a scan line unit according to the horizontal synchronization signal Hsync to generate an image data DAT.

The signal controller 100 transfers the first driving control signal CONT1 to the scan driver 200, and transfers the image data DAT to the data driver 300 with the second driving control signal CONT2.

The scan driver 200 is connected to the scan lines S1 to Sn to generate scan signals according to the first driving control signal CONT1. The scan driver 200 may sequentially apply the scanning signals of gate-on voltages to the scan lines S1 to Sn.

The data driver 300 is connected to the data lines D1 to Dm to sample and hold the input image data DAT according to the second driving control signal CONT2. The data driver 200 then applies the data signals to the data lines D1 to Dm. The data driver 300 may include a memory for sampling and holding the image data DAT.

The data driver 300 may apply data signals within a predetermined voltage range to the data lines D1 to Dm in response to the scanning signals of the gate-on voltages. For example, when the scanning signals of the gate-on voltages are sequentially applied at an interval of 1 horizontal period 1H, the data driver 300 may apply the data signals to the data lines D1 to Dm at an interval of 1 horizontal period 1H. The 1 horizontal period may be the same as a period of the horizontal synchronization signal Hsync.

The clock oscillator 500 generates a clock signal OSC_CLK and transfers the clock signal OSC_CLK to the data driver 300. The clock oscillator 500 maintains a stop state when a moving image is displayed, and operates when a still image is displayed to generate the clock signal OSC_CLK. When the clock oscillator 500 receives a control signal for a still image from an external device, the clock oscillator 500 generates the clock signal OSC_CLK. When the clock oscillator 500 receives a control signal for moving images, the clock oscillator 500 may stop the generation of the clock signal OSC_CLK.

The register 350 stores a clock signal parameter CLK_para for the clock signal OSC_CLK generated from the clock oscillator 500. The clock signal parameter CLK_para may be transferred from register 350 to the data driver 300.

The data driver 300 receives the clock signal OSC_CLK from the clock oscillator 500, and applies the data signals to the data lines D1 to Dm in synchronization with the clock signal OSC_CLK. In one embodiment, the data driver 300 determines the number of clock signals OSC_CLK included for the 1 horizontal period 1H according to the clock signal parameter CLK_para stored in the register 350. That is, the data driver 300 determines a width of the horizontal period according to the clock signal parameter CLK_para. The data driver 300 applies the data signals to the data lines D1 to Dm based on the 1 horizontal period.

The data driver 300 may receive a main clock signal MCLK when moving images are to be displayed, and may apply data signals to the data lines D1 to Dm in synchronization with the main clock signal MCLK. The data driver 300 receives the clock signal OSC_CLK from the clock oscillator 500 instead of the main clock signal MCLK when a still image is to be displayed. Also, the data driver may apply the data signals to the data lines D1 to Dm in synchronization with the clock signal OSC_CLK.

The clock oscillator 500 and register 350 may be provided separately from the data driver 300. In other embodiments, one or both of the clock oscillator 500 and register 350 are included in the data driver 300.

The aforementioned driving devices 100, 200, 300, 350, and 500 may be directly installed on the display unit 400, for example, in at least one integrated circuit (IC) chip form. In other embodiments, the driving devices may be installed on a flexible printed circuit film attached to the display unit 400 in a tape carrier package (TCP) form, or may be installed on a separate printed circuit board (PCB). Further, the driving devices 100, 200, 300, 350, and 500 may be integrated in the display unit 400 with the scan lines S1 to Sn and data lines D1 to Dm.

Figure 2:
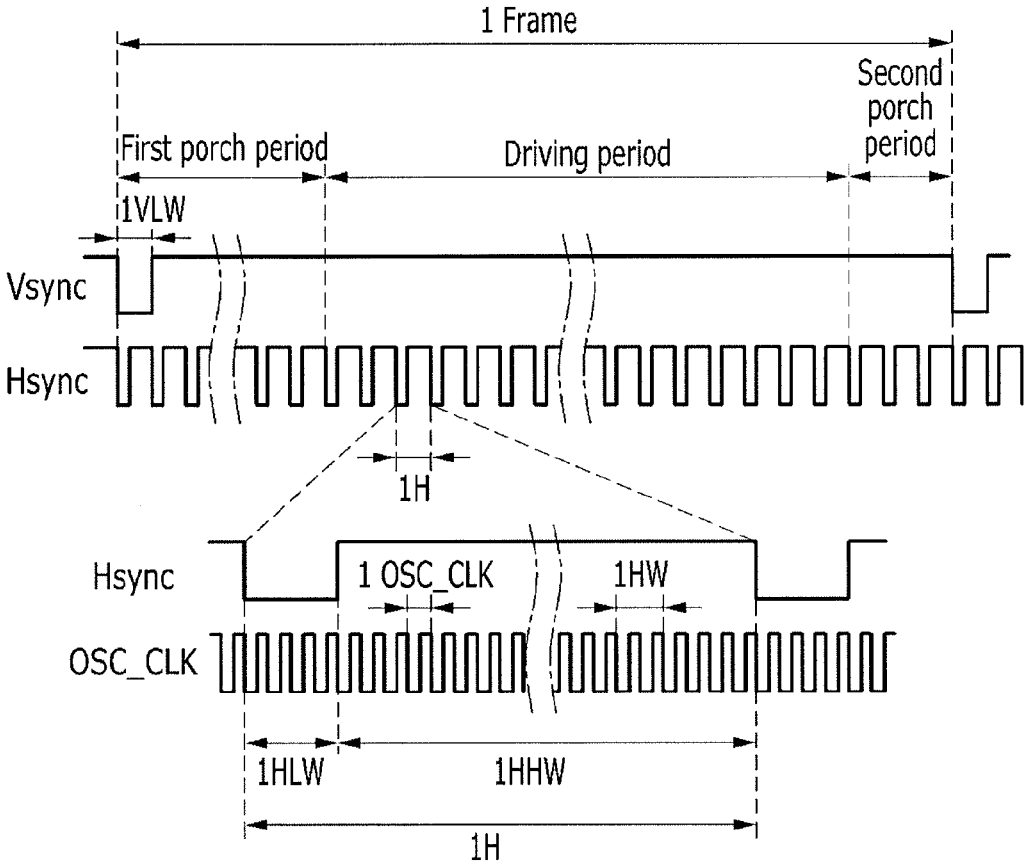
FIG. 2 illustrates a waveform diagram for one frame of the display device.

FIG. 2 illustrates an example of a waveform diagram of one frame for driving the display device. Referring to FIG. 2, one frame includes a first porch period, a driving period, and a second porch period during a time when one image is displayed. One frame may be divided by the vertical synchronization signal Vsync. That is, an interval of a time when the vertical synchronization signal Vsync of an on-voltage is applied may correspond to one frame. A width 1 VLW at which the vertical synchronization signal Vsync is applied as the on-voltage may be approximately 1 to 4 horizontal periods.

In one embodiment, it may be assumed that the on-voltage is a low-level voltage and an off-voltage is a high-level voltage. Unless otherwise indicated, a signal may be considered to be an on-voltage.

The driving period is a period when the scanning signals of the gate-on voltages are output. The data signals are output in response to the scanning signals of the gate-on voltages. As a result, the data signals are input to the pixels. The scanning signals of the gate-on voltages may be sequentially output at an interval of 1 horizontal period 1H. The 1 horizontal period 1H may correspond to an interval at which the horizontal synchronization signal Hsync of the on-voltage is applied, e.g., a period of the horizontal synchronization signal Hsync.

The first porch period is a predetermined time interval up to a driving period of a current frame, after a previous frame is completed. The first porch period may be set to a predetermined number of horizontal periods, e.g., 13 horizontal periods.

The second porch period is a predetermined time interval up to the next frame, after the driving period of the current frame is completed. The second porch period may be set to a predetermined number of horizontal periods, e.g., 3 horizontal periods.

Time widths of the first and second porch periods may be variously adjusted according to a period of the frame and/or the number of scan lines S1 to Sn in the display device 10.

In one embodiment, 1 horizontal period 1H may include 1 horizontal low width 1HLW and 1 horizontal high width 1HHW. The 1 horizontal low width 1HLW may correspond to a time when the horizontal synchronization signal Hsync is applied as the on-voltage. The 1 horizontal high width 1HHW may correspond to a time when the horizontal synchronization signal Hsync is applied as the off-voltage.

A predetermined number (e.g., four) clock signals OSC_CLK may be included in the 1 horizontal low width 1HLW. A plurality of clock signals OSC_CLK may be included in the 1 horizontal high width 1HHW. A 1 clock signal time 1 OSC_CLK may correspond to a time interval before the clock signal OSC_CLK of the on-voltage is applied again, after the clock signal OSC_CLK of the on-voltage is applied.

Also, 1 horizontal width 1HW may be defined as a predetermined number (e.g., 2) clock signal times 2 OSC_CLK. In this case, the predetermined number (two) clock signals OSC_CLK are included in the 1 horizontal width 1HW. The 1 horizontal width 1HW may be a minimum clock unit which is usable in the data driver 300.

In this case, the number of clock signals OSC_CLK in 1 horizontal high width 1HHW may be determined by the clock signal parameter CLK_para. That is, the clock signal parameter CLK_para provides an indication of the number of clock signals OSC_CLK in 1 horizontal period 1H. The number of clock signals OSC_CLK in the 1 horizontal high width 1HHW may be controlled by 1 horizontal width 1HW unit. In this case, the clock signal parameter CLK_para may provide an indication of the number of clock signals OSC_CLK in the 1 horizontal period 1H as 1 horizontal width 1HW unit. That is, the clock signal parameter CLK_para instructs the number of 1 horizontal widths HW that are to be included in 1 horizontal period 1H.

For example, it may be assumed that a frequency of the frame of the display device 10 having 1920 scan lines is 60 Hz. In this case, 60 images are displayed per second. The frame period is therefore 1/60 Hz=16.67 ms. When the first porch period is 13 horizontal periods, the driving period is 1920 horizontal periods, and the second porch period is 3 horizontal periods, one frame has 1936(=13+1920+3) horizontal periods. The 1 horizontal period 1H is 16.67 ms/1936=8.61 us.

When a reference frequency of the clock signal OSC_CLK is 75.8 Mhz, 1 clock signal time 1 OSC_CLK is 1/75.8 Mhz=13.193 ns. The 1 horizontal width 1HW is 26.4 ns. In this case, 326 (=8.61 μs/26.4 ns) horizontal widths HW are included in 1 horizontal period 1H. That is, 652 clock signals OSC_CLK are included in 1 horizontal period 1H.

When the clock oscillator 500 outputs the clock signal OSC_CLK as a reference frequency of 75.8 Mhz, the clock signal parameter CLK_para stored in register 350 may provide an indication of the number of 1 horizontal widths 1HW in 1 horizontal period 1H as 326. Further, the clock signal parameter CLK_para may provide an indication of the number of clock signals OSC_CLK in 1 horizontal period 1H as 652.

Under certain circumstances, the frequency of clock oscillator 500 may have a distribution of approximately 7% due to process deviation. The frequency of the clock oscillator 500 may therefore be represented as approximately 70.8 Mhz to 81.1 Mhz.

For example, it may be assumed that the frequency of clock oscillator 500, in which the reference frequency is 75.8 Mhz, is 70.8 Mhz due to process deviation. In this case, the 1 clock signal time 1 OSC_CLK is 1/70.8 Mhz=14.14 ns and 1 horizontal width 1HW is 28.2 ns. When the number of 1 horizontal widths 1HW in 1 horizontal period 1H is 326, 1 horizontal period 1H is 28.2 ns×326=9.21 μs, and larger than 8.61 us of a reference 1 horizontal period 1H by 0.6 μs. In this case, the frame period is 9.21 μs×1936=17.83 ms and the frame frequency is 56.1 Hz.

This is different from a reference frame period of 16.67 ms and a reference frame frequency of 60 Hz. The signal controller 100 transfers the image data DAT generated according to the reference frame frequency of 60 Hz to the data driver 300. However, when the data driver 300 is driven according to a frame frequency of 56.1 Hz, a tearing phenomenon, a dot noise phenomenon, or the like may occur due to mismatch between the reference frame frequency and data signal frequency.

As described above, when the clock signal parameter CLK_para indicates that the number of 1 horizontal widths 1HW to be included in the 1 horizontal period 1H is 305 to register 350 in response to the frequency of the clock oscillator 500 of 70.8 Mhz, the 1 horizontal period 1H may be expressed as 28.2 ns×305=8.60 V. The frame period may be expressed as 8.60 μs×1936=16.65 ms and the frame frequency may be 60 Hz. Accordingly, the frame period and frame frequency are synchronized with each other, so that the data driver 300 outputs the data signals.

As such, even though the frequency of the clock oscillator 500 is different from the reference frequency, the frame period and frame frequency generated using clock signal OSC_CLK are almost the same as the reference frame period of 16.67 ms and the reference frame frequency of 60 Hz. That is, the clock signal parameter CLK_para indicates the number of clock signals OSC_CLK to be included in the 1 horizontal period, so that a synchronized frame outputting the data signal coincides with the reference frame.

Figure 3:
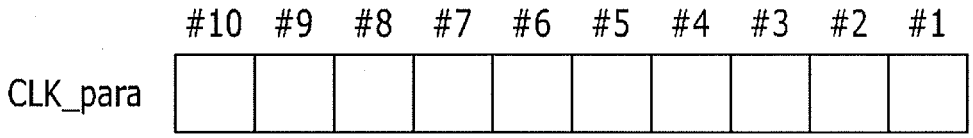
FIG. 3 illustrates an example of a clock signal parameter registered in a register.

FIG. 3 illustrates an example of a parameter of a clock signal registered in a register. Referring to FIG. 3, clock signal parameter CLK_para may be provided as 10 bits. When the clock signal parameter CLK_para indicates the number of 1 horizontal widths 1HW in 1 horizontal period 1 H, the clock signal parameter CLK_para of 10 bits may indicate the number of 1 horizontal widths 1HW in 1 horizontal period 1H as 1 to 1024. Alternatively, when the clock signal parameter CLK_para instructs the number of clock signals included in the 1 horizontal period 1H, the clock signal parameter CLK_para of 10 bits may instruct the number of clock signals OSC_CLK included in the 1 horizontal period 1H as 1 to 1024.

For example, when the number of 1 horizontal widths 1HW in 1 horizontal period 1H is 305, clock signal parameter CLK_para may be expressed as '0100110001'.

In the present embodiment, the clock signal parameter corresponds to a bit number. In other embodiments, the clock signal parameter CLK_para may be a different parameter.

Figure 4:
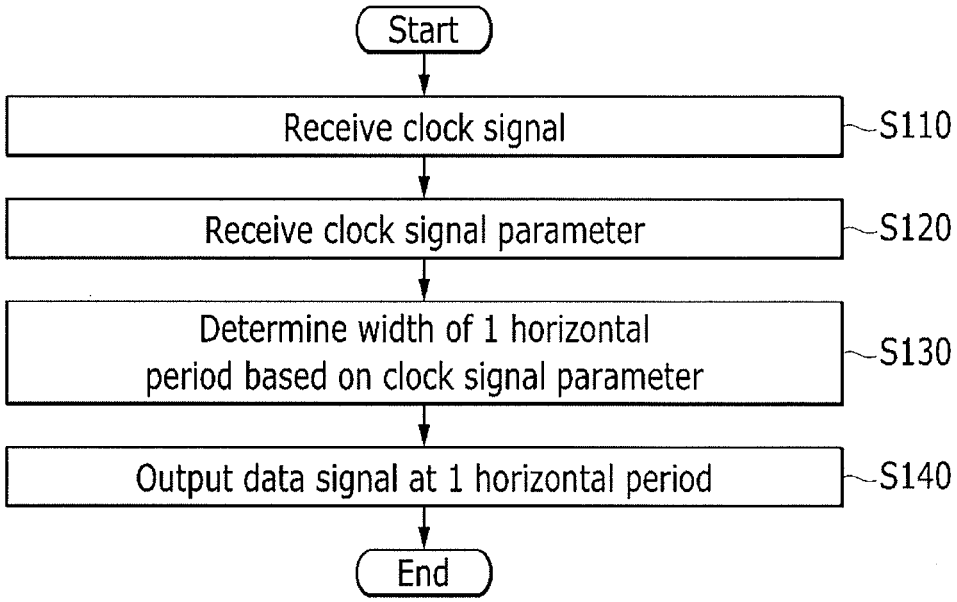
FIG. 4 illustrates an embodiment of a method for driving a display device.

FIG. 4 illustrates operations included in an embodiment of a method for driving a display device. Referring to FIG. 4, the data driver 300 receives clock signal OSC_CLK from clock oscillator 500 through a first input (S110). The clock signal OSC_CLK provides synchronization for applying data signals to the data lines D1 to Dm to which the pixels are connected. The clock signal OSC_CLK may be provided to the data driver 300, for example, in the case where a still image is to be displayed.

The data driver 300 receives the clock signal parameter CLK_para for the clock signal OSC_CLK from register 350 through a second input (S120). The clock signal parameter CLK_para indicates the number of clock signals OSC_CLK included in the 1 horizontal period 1H or the 1 horizontal widths 1HW.

The data driver 300 determines a width of 1 horizontal period 1H based on the clock signal parameter CLK_para (S130). For example, when the clock signal parameter CLK_para for clock signal OSC_CLK, of the clock oscillator 500 having a frequency is 70.8 Mhz, indicates the number of 1 horizontal widths 1HW in the 1 horizontal period 1H as 305, the width of the 1 horizontal period 1H is 8.60 us.

The data driver 300 outputs the data signals to the data lines D1 to Dm at an interval of 1 horizontal period for the driving period in one frame (S140).

The clock signal parameter CLK_para instructs the number of 1 horizontal widths 1HW in the 1 horizontal period 1H to the register 350, in response to the frequency of the clock oscillator 500. The data driver 300 outputs the data signals according to the 1 horizontal period 1H determined based on the clock signal parameter CLK_para. Accordingly, even though the frequency of the clock oscillator 500 is different from the reference frequency because of process deviations, the frame period and frame frequency generated using clock signal OSC_CLK are almost the same as the reference frame period of 16.67 ms and reference frame frequency of 60 Hz. As a result, a tearing phenomenon, a dot noise phenomenon, or the like, may be prevented bas a result of a mismatch between the reference frame frequency and data signal frequency.

As such, the clock signal parameter CLK_para indicates the number of clock signals OSC_CLK in the 1 horizontal period, so that a synchronized frame outputting the data signals coincides with the reference frame.

Figure 5:
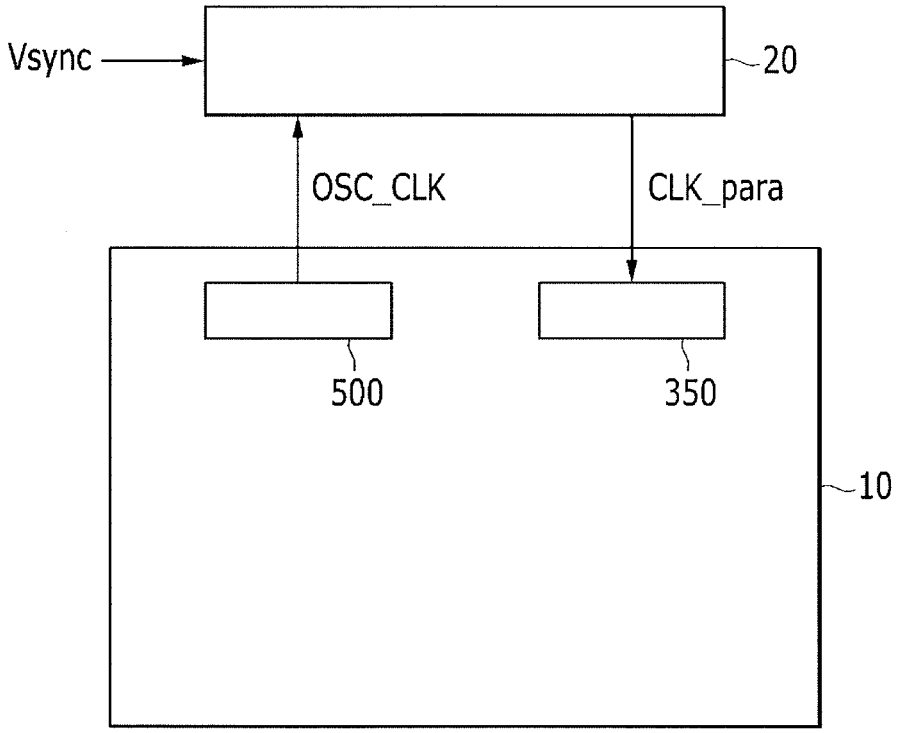
FIG. 5 illustrates a diagram corresponding to an embodiment of a method for registering a clock signal parameter in a register.
Figure 6:
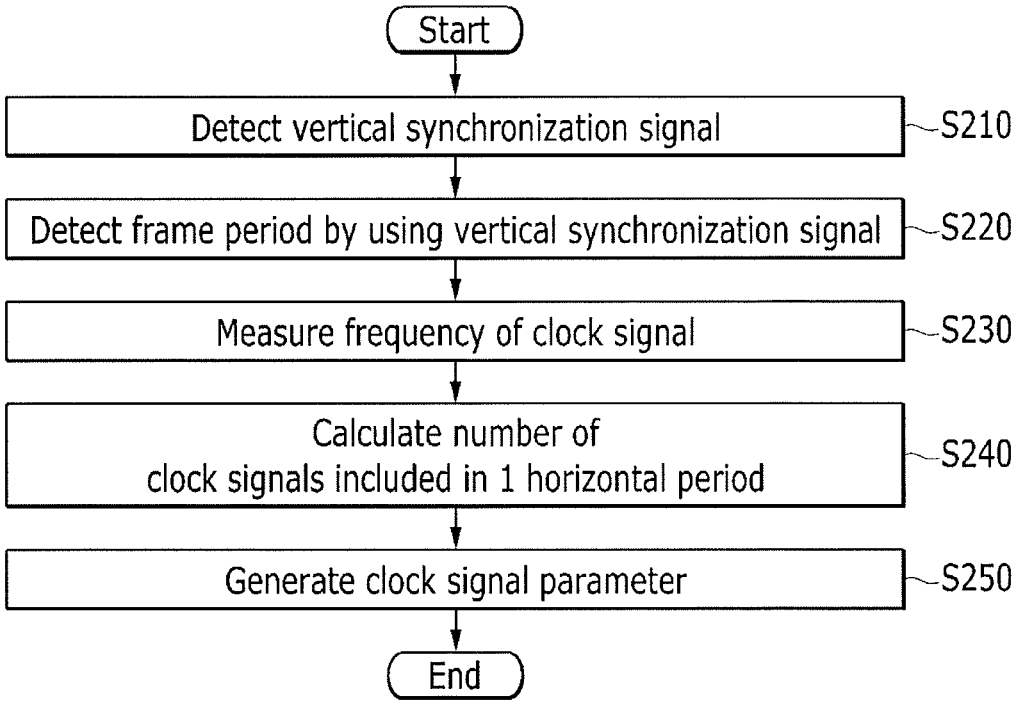
FIG. 6 illustrates operations included in the method corresponding to FIG. 5.

FIGS. 5 and 6 correspond to an embodiment of a method for registering a clock signal parameter CLK_para in register 350. More specifically, FIG. 5 illustrates a block diagram describing an embodiment of a method for registering a clock signal parameter in a register. FIG. 6 illustrates operations included in the method embodiment.

Referring to FIGS. 5 and 6, a process in which the clock signal parameter CLK_para is registered in the register 350 of the display device 10 may be performed by a clock signal inspecting device 20. The clock signal inspecting device 20 may be a device for inspecting a defect of display device 10 during a manufacturing process of the display device 10, or a device for inspecting performance of clock oscillator 500 during the manufacturing process of the clock oscillator 500.

In performing the method, the clock signal inspecting device 20 detects the vertical synchronization signal Vsync of the display device 10 (S210). A period of the vertical synchronization signal Vsync may be detected by measuring an output interval of the vertical synchronization signal Vsync which is periodically output.

Because the period of the vertical synchronization signal Vsync is the same as the period of the frame, the frame period of the display device 10 may be detected using the vertical synchronization signal Vsync (S220). That is, the frame period may be detected by measuring the vertical synchronization signal Vsync many times and measuring an output interval of the vertical synchronization signal Vsync. The frame period corresponds to a period of the vertical synchronization signal Vsync. For example, when 60 vertical synchronization signals Vsync are output for one second, the frame frequency is 60 Hz and the frame period is 1/60 Hz=16.67 ms.

The clock signal inspecting device 20 measures the frequency of clock signal OSC_CLK output from clock oscillator 500 (S230). The frequency of the clock signal OSC_CLK may be measured by the number of clock signals OSC_CLK per one second.

The clock signal inspecting device 20 calculates the number of clock signals OSC_CLK in 1 horizontal period 1H (S240). For example, it may be assumed that the frame period is detected as 16.67 ms and the frequency of the clock signal OSC_CLK is detected as 75.8 Mhz. When 1936 horizontal periods are in one frame, the 1 horizontal period 1H is 16.67 ms/1936=8.61 vs. The 1 clock signal time 1 OSC_CLK is 1/75.8 Mhz=13.193 ns. The 1 horizontal width 1HW is 26.4 ns. In this case, 326 (=8.61 μs/26.4 ns) horizontal widths HW are included in 1 horizontal period 1H. That is, 652 clock signals OSC_CLK are included in 1 horizontal period 1H.

The clock signal inspecting device 20 generates a clock signal parameter OSC_CLK indicating the number of clock signals OSC_CLK in 1 horizontal period 1H, or the number of horizontal widths HW in 1 horizontal period 1H, and the generated clock signal parameter OSC_CLK is registered in register 350.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display device, comprising:

a clock oscillator configured to generate a clock signal;

a register configured to store a clock signal parameter for the clock signal; and a data driver configured to determine a number of clock signals in 1 horizontal period based on the clock signal parameter, and to apply a plurality of data signals to a plurality of data lines connected to a plurality of pixels based on the 1 horizontal period.

2. The display device as claimed in claim 1, wherein the data driver is to apply the data signals to the data lines at an interval of the 1 horizontal period.

3. The display device as claimed in claim 1, wherein the clock oscillator is to generate the clock signal when a still image is to be displayed.

4. The display device as claimed in claim 3, wherein the data driver is to receive a main clock signal when moving images are to be displayed, and is to receive the clock signal instead of the main clock signal when the still image is to be displayed.

5. The display device as claimed in claim 1, wherein:

the clock signal parameter indicates the number of clock signals in the 1 horizontal period based on 1 horizontal width unit, and the 1 horizontal width includes two clock signals.

6. The display device as claimed in claim 1, wherein the clock signal parameter indicates the number of clock signals in the 1 horizontal period.

7. The display device as claimed in claim 1, wherein the clock signal parameter indicates the number of clock signals in the 1 horizontal period, the number of clock signals in the 1 horizontal period allowing a synchronized frame for outputting the data signals to substantially coincide with a reference frame.

8. The display device as claimed in claim 1, wherein the clock signal parameter is 10 bits.

9. A method for driving a display device, the method comprising:

receiving a clock signal to synchronize applying data signals to data lines to which a plurality of pixels is connected;

receiving a clock signal parameter for the clock signal;

determining a width of 1 horizontal period based on the clock signal parameter; and outputting the data signals to the data lines at an interval of the 1 horizontal period.

10. The method as claimed in claim 9, wherein:

the clock signal parameter indicates the number of clock signals in the 1 horizontal period for 1 horizontal width unit, and the 1 horizontal width includes two clock signals.

11. The method as claimed in claim 9, wherein the clock signal parameter indicates the number of clock signals in the 1 horizontal period.

12. The method as claimed in claim 9, wherein the clock signal parameter indicates the number of clock signals in the 1 horizontal period, the number of clock signals in the 1 horizontal period to allow a synchronized frame outputting the data signals to substantially coincide with a reference frame.

13. The method as claimed in claim 9, wherein the clock signal is generated when a still image is to be displayed.

14. The method as claimed in claim 9, further comprising:

pre-registering the clock signal parameter in a register.

15. The method as claimed in claim 14, wherein pre-registering the clock signal parameter includes:

detecting a vertical synchronization signal of the display device;

detecting a frame period of the display device based on the vertical synchronization signal;

measuring a frequency of the clock signal; and calculating the number of clock signals in the 1 horizontal period included in the frame.

16. The method as claimed in claim 15, wherein the frame period is substantially equal to the period of the vertical synchronization signal.

17. An apparatus, comprising:

at least one input; and a driver to receive a signal including a clock signal parameter through the input, wherein the driver is to determine a number of clock signals in a period of a display device based on the clock signal parameter and is to control data signals to data lines of the display device based on the period.

18. The apparatus as claimed in claim 17, wherein the clock signal parameter is a predetermined number of bits.

19. The apparatus as claimed in claim 17, wherein:

the clock signal parameter indicates the number of clock signals in the period based on 1 horizontal width unit, and the 1 horizontal width includes a plurality of clock signals.

20. The apparatus as claimed in claim 17, wherein:

the clock signal parameter indicates the number of clock signals in the period, a synchronized frame for outputting data signals substantially coinciding with a reference frame based on the number of clock signals in the period.

* * * * *